US005768926A

United States Patent [19]

Shen

[11] Patent Number: 5,768,926

[45] Date of Patent: Jun. 23, 1998

[54] LOCK HAVING AN EXTERIOR DOOR HANDLE CAPABLE OF A FREE TURNING MOVEMENT

[76] Inventor: Mu-lin Shen, No. 32, Lane 76, Sec. 5, Fu-an Rd., Tainan, Taiwan

[21] Appl. No.: 743,908

[22] Filed: Nov. 4, 1996

[51] Int. Cl.[6] ..... E05B 55/06

[52] U.S. Cl. ..... 70/472; 70/149; 70/222; 70/224; 70/422

[58] Field of Search ..... 70/422, 224, 221–223, 70/472, 149, 218, 188, 189, 204; 292/DIG. 27

[56] References Cited

U.S. PATENT DOCUMENTS

| | | | |
|---|---|---|---|
| 1,986,451 | 1/1935 | Shaw | 70/221 |
| 3,024,055 | 3/1962 | Novarino | 70/149 |
| 3,896,644 | 7/1975 | Nagy et al. | 70/222 X |
| 3,896,645 | 7/1975 | Nagy et al. | 70/149 |
| 4,428,212 | 1/1984 | Best et al. | 70/224 |
| 4,869,083 | 9/1989 | DeMarseilles et al. | 70/224 |
| 4,920,773 | 5/1990 | Surko, Jr. | 70/149 X |
| 4,921,289 | 5/1990 | Shen | 292/336.3 |

FOREIGN PATENT DOCUMENTS

| | | | |
|---|---|---|---|
| 463352 | 2/1950 | Canada | 70/224 |

*Primary Examiner*—Lloyd A. Gall
*Attorney, Agent, or Firm*—Dellett and Walters

[57] ABSTRACT

A lock sub-assembly for a lock which is mainly situated at an exterior side of the lock. The lock sub-assembly comprises an exterior hub configured to rotate together with an exterior long handle and be fixed to an exterior side of a lock chassis, a handle spindle rotatably received within the exterior hub, a restricting block fixedly secured within the exterior hub, the restricting block disposed to. effectuate a limited turning movement of the handle spindle with respect to the exterior hub, an actuating spindle extending through both the restricting block and the handle spindle and having a roll-back portion adapted to operate a retractor, and a mechanism for releasably coupling the actuating spindle to the handle spindle. With this construction, when the actuating spindle and the handle spindle are not rotatably coupled together, the exterior long handle together with the handle spindle performs such a turning movement that no other constituting elements are affected thereby.

4 Claims, 6 Drawing Sheets

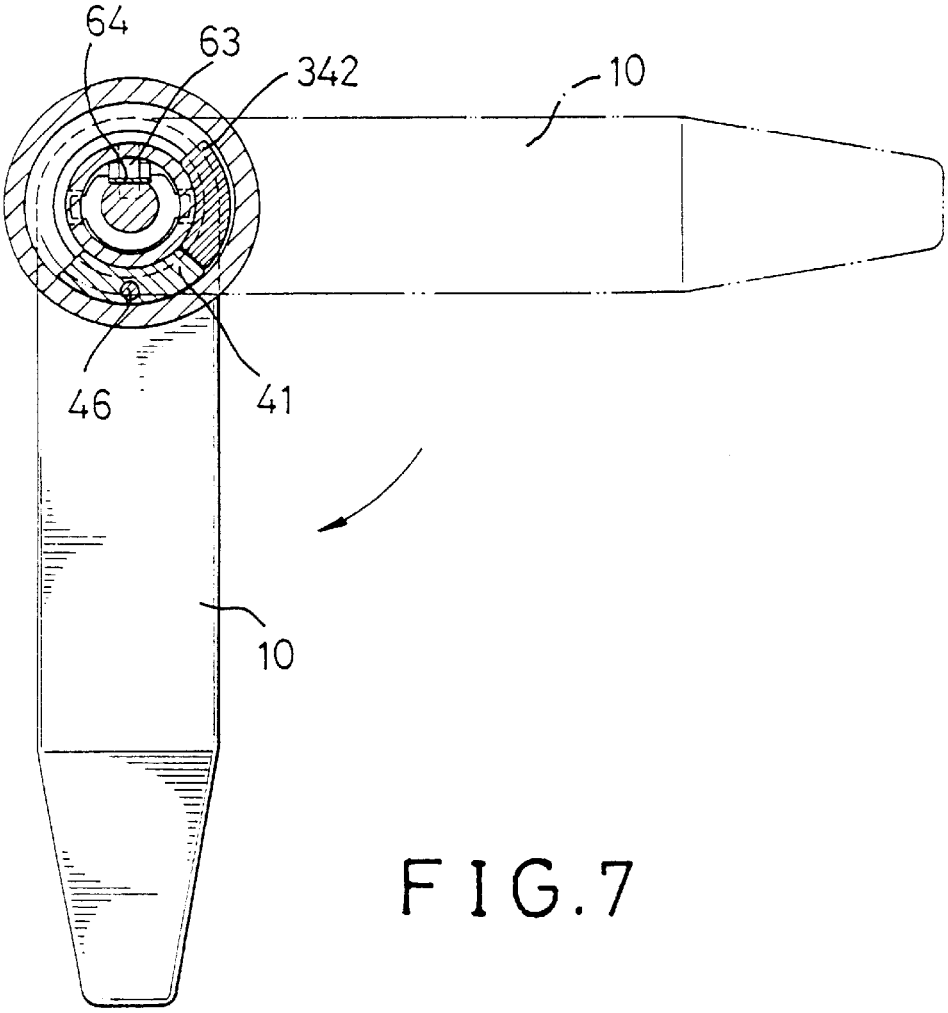
FIG.7
FIG.8
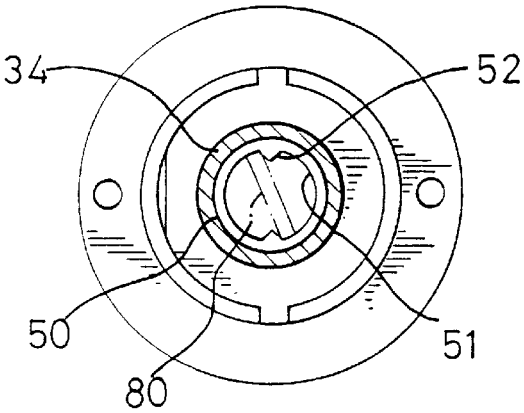

LOCK HAVING AN EXTERIOR DOOR HANDLE CAPABLE OF A FREE TURNING MOVEMENT

BACKGROUND OF THE INVENTION

1. Field of the Invention

The present invention relates to a cylinder lock, particularly to a lock which, while having long handles particularly but not exclusively for handicapped people for convenient operation, prevents the long handles from being purposely utilized to damage the lock.

2. Description of Related Art

One type of cylindrical lever lock structure for use by physically challenged is disclosed in U.S Pat. No. 4,921,289. In this structure, an easily operable and durable long handle and robust lock body is provided. However, it is found that the long handle may be intentionally used by unauthorized persons to damage the lock by forcibly manipulating the long handle from an exterior when the lock is locked from an interior. This is so because the outer spindle is still mechanically linked via a retractor to the latch bolt assembly but is only contactingly blocked from operating on the latch bolt assembly.

The present invention thus aims to mitigate and/or obviate the above-mentioned drawback by providing a cylinder lock in which, when in a locked state, the outer spindle is disengaged from any other components of the lock structure so that the outer spindle together with the long handle connected thereto are turnable in a controlled manner.

SUMMARY OF THE INVENTION

A primary object of the present invention is to provide a lock sub-assembly for a cylinder lock of the type having a chassis, a retractor received within the chassis, an interior hub fixed to an interior side of the chassis, an interior long handle and an exterior long handle, and an interior cam sleeve rotatable with the interior long handle within the interior hub, the lock sub-assembly being disposed at an exterior side of the lock (i.e., to an exterior of a door as in contrast to an interior of the door) and permitting a controlled turning movement of the exterior long handle under which the exterior long handle either serves a normal use to open a door via an actuating spindle or is turnable, while not coupling to the actuating spindle, to such an extent and degree that the other constituting elements of the subject lock are affected to a minimum In accordance with one feature of the invention, a handle spindle is fixedly secured to the exterior long handle to be rotatable together therewith and a slider capable of a translational movement and a follower capable of an upward or a downward movement in response to the translational movement of the slider to establish or release a coupling relationship between the handle spindle and the actuating spindle.

Preferably, the translational movement of the slider to release the coupling is effected by a locking push button.

In accordance with another feature of the invention, a restricting block is firmly secured to an exterior hub with an integral stopper of the handle spindle rotatable within a space defined between the handle spindle and the restricting block to a predetermined angle.

A plurality of aligned holes are suitably defined in the exterior hub and the restricting block, respectively, so that fasteners can extend through these aligned holes to fixedly secure the restricting block within the exterior hub.

To allow a turning movement of the actuating spindle to thereby open a door, the actuating spindle is provided with a pair of tabs at an exterior end thereof adapted to be operable by a tang of a key assembly.

Other objects, advantages and novel features of the invention will become more apparent from the following detailed description when taken in conjunction with the accompanying drawings.

BRIEF DESCRIPTION OF THE DRAWINGS

FIG. 7 is a view taken along line 7—7 of FIG. 6 which is similar to a combination of FIG. 4 and FIG. 5 but at the locked state of FIG. 6; and FIG. 8 is a view taken along line 8—8 of FIG. 6 which shows the relationship of a cam sleeve and a throw member for operating the cam sleeve.

DETAILED DESCRIPTION OF PREFERRED EMBODIMENT

Figure 1:
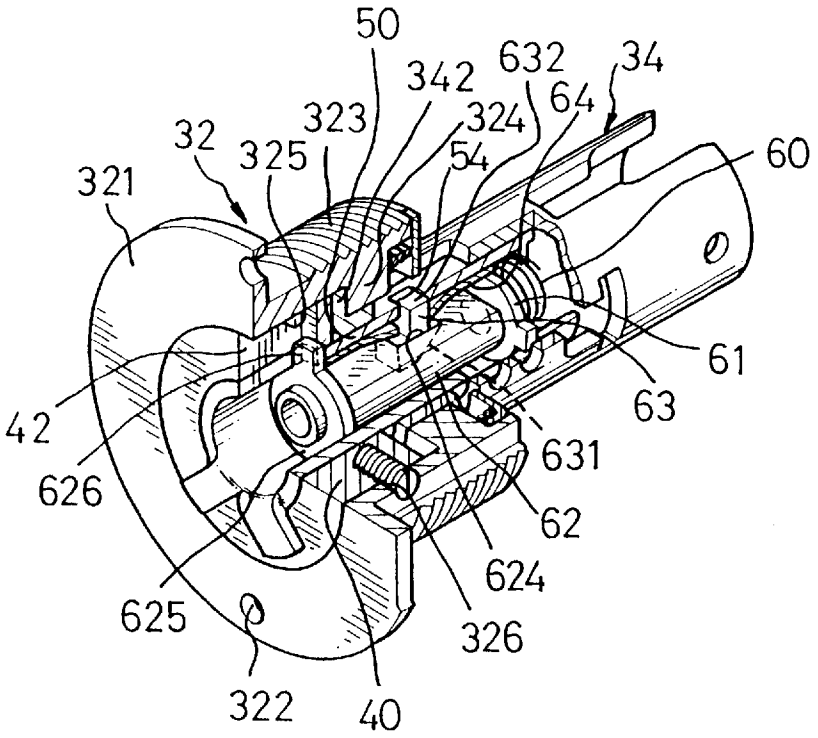
FIG. 1 is a partly cut-away perspective view showing the construction of an exterior lock sub-assembly in accordance with the present invention.
Figure 2:
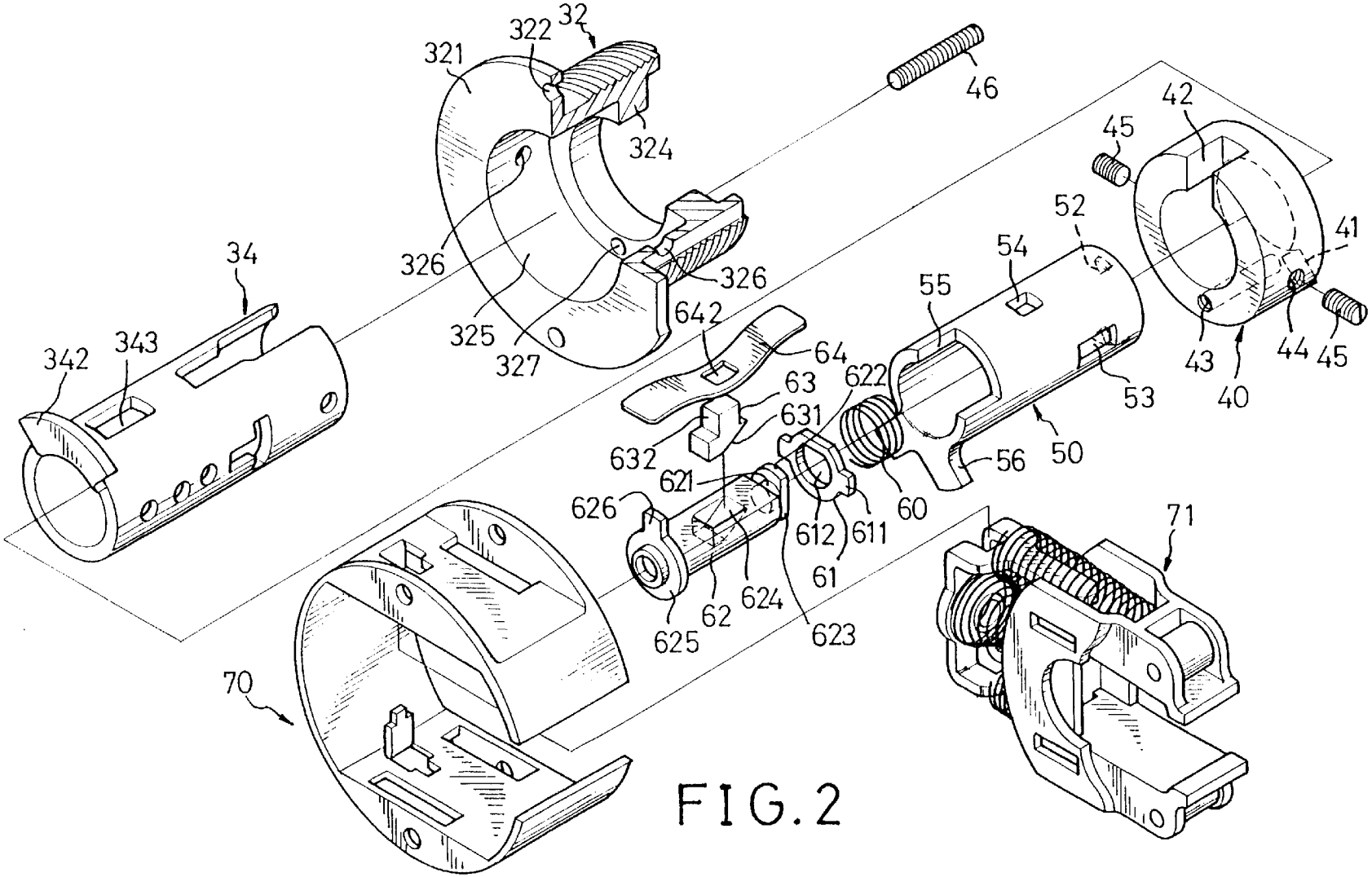
FIG. 2 is an exploded perspective view of the lock subassembly of FIG. 1, together with a chassis to which the lock sub-assembly is attached and a retractor mounted within the chassis.

FIG. 1 shows a lock sub-assembly in assembled perspective view. FIG. 2 shows the lock sub-assembly in exploded view, together with a lock chassis 70 to which the lock sub-assembly is attached and a retractor 71 mounted within the chassis 70. The retractor may be of such a design as disclosed in above-mentioned U.S. Pat. No. 4,921,289 incorporated herein by reference. The lock sub-assembly comprises a hub 32, a handle spindle 34 rotatably received within the hub 32, a restricting block 40 fixedly secured within the hub 32, and an actuating spindle 50 extending through both the restricting block 40 and the handle spindle 34. The hub 32 has a flange 321 at an end facing the chassis 70 with holes 322 provided thereon for bolts or screws to extend therethrough, thus the hub 32 can be securely fixed to the chassis 70. A protruding step 324 is formed on an inner wall of the hub 32 and a hole 327 is provided through the step 324. An inner wall 325 formed between the end having the flange 321 and the step 324 is provided with through-holes 326. The handle spindle 34 is substantially a hollow cylinder and has a stopper 342 on an end thereof and a slot 343 substantially adjacent to the stopper 342. When the handle spindle 34 is received within the hub 32, the stopper 342 is at a position proximate to the step 324 of the hub 32. The restricting block 40 has a bottom threaded hole 43 so that a screw 46 can extend through the hole 327 and then be screwed into the threaded hole 43. Also provided in the restricting block 40 is a pair of side threaded holes 44 at positions corresponding to the pair of holes 326 of the hub 32. A pair of screws 45 can pass through the holes 326 into the threaded holes 44. The block 40 thus can be fixedly secured within the hub 32 by way of the pair of screws 45 extending in a radial direction and the screw 46 extending in an axial direction.

Corresponding to the stopper 342 on the handle spindle 34, there is a protrusion 41 formed on the restricting block 40. The protrusion 41 spans approximately 90°, i.e., one-fourth of a full 360° circle. The stopper 342 also spans approximately this 90° extent. The protrusion 41 extends from the main body of the block 40 a height such that, when the block 40 is fixedly secured to the hub 32, the protrusion 41 nearly contacts the step 324 of the hub 32 and a space is defined by the block 40 and the hub 32 to allow a limited rotational movement of the stopper 342 within the space. With this arrangement, the stopper 342 along with the spindle 34 on which it is disposed can be expected to have a rotational movement about the central axis of the spindle 34 of approximately 90° toward either direction until it is stopped by the protrusion 41 of the restricting block 40. A notch 42 is formed on the block 40, the purpose of which will become clear as the description proceeds.

The actuating spindle 50 has a roll-back portion 56 for operating the retractor 71 which in turn will cooperate with a latch bolt assembly (not shown) in a known manner to retract a latch bolt (not shown) . A notch 55 is formed at a position substantially corresponding to that of the notch 42. As viewed from an axial direction, the notch 55 spans approximately 90°. An opening 54 is provided on a side wall of the spindle 50 at such a position that, when both the handle spindle 34 and the actuating spindle 50 are mounted as seen in FIG. 2, the opening 54 aligns with the slot 343 on the spindle 34, the purpose of which will become clear as the description proceeds.

The lock sub-assembly also comprises a slider 62, a follower 63, a plate spring 64, a support piece 625, a spring stop 61 and a coil spring 60, all being substantially contained within the actuating spindle 50. The slider 62 has a cylindrical end which rotatably connects to the support piece 625. The support piece 625 has an integral ear 626 which, when being inserted into the actuating spindle 50, is located at the notch 55 on the spindle 50 and the notch 42 on the restricting block 40. Since the support piece 625 is only axially movable but not rotatable due to the engagement of the ear 626 with the notch 42, the direction of rotation of the spindle 50 is confined. The opposite end of the slider 62 forms a disk head 622 connected by a neck 621 to the main body of the slider 62. The disk head 622 has a flat portion 623. The spring stop 61 is to be disposed within the spindle 50. For this purpose, a pair of slots 53 are provided in the wall of the spindle 50 and a pair of wings 611 are formed on the spring stop 61. When received in position, the spring stop 61 is only capable of a translational movement with respect to the spindle 50 regulated by the engagement of the wings 611 and the slots 53. The spring stop 61 has a central hole 612 of a shape complementary to the shape of the disk head 622 but differently oriented, for example 90° out of phase, so that after the disk head 622 enters the hole 612 and then turns, the slider 62 will be moved together with the spring stop 61. The coil spring 60 is compressed between the spring stop 61 and a pair of tabs 52 formed at an end of the spindle 50 opposite to that which forms the roll-back portion 56.

The follower 63 is used to transmit a rotational movement of the handle spindle 34 to the actuating spindle 50 under a controlled manner. To achieve this, a tapered recess 624 is provided on an upper planar face of the slider 62 for engaging with a tapered end 631 of the follower 63 and an opposite rectangular end 632 of the follower 63 having a smaller outside dimension than that of the tapered end 631 extends through an opening 642 of the plate spring 64 and into the opening 54 of the spindle 50. A translational movement of the slider 62 with respect to the spindle 50 can thus be converted into an upward or an downward movement of the follower 63 with the aid of an urging action from the plate spring 64.

It is noted that the follower 63 can be of a shape other than rectangular as is specifically shown in the figures. In such a case, for example, the end 631 of the follower 63 and the mating recess 624 of the slider 62 can both be of a conical shape. Similarly, the end 632 of the follower 63 can be of a cylindrical shape and the opening 642 of the plate spring 64 can be of a circular shape.

With the lock sub-assembly of the invention thus constructed as above-described, the operation of the lock sub-assembly is now to be described with particular reference to FIGS. 3 through 8.

Figure 4:
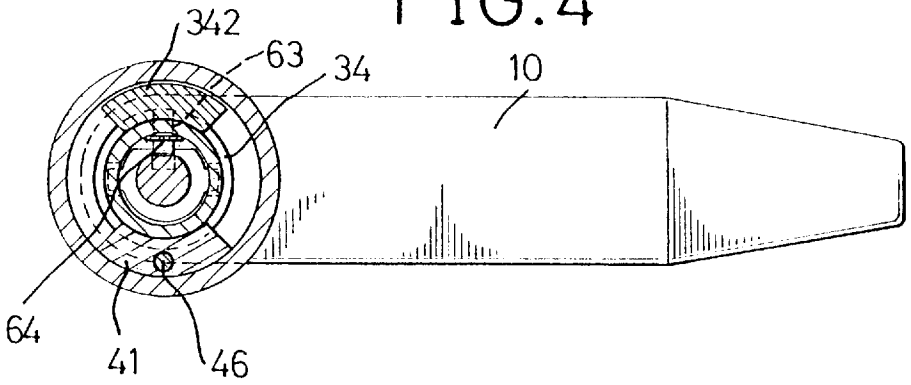
FIG. 4 is a view taken along line 4—4 of FIG. 3, giving a relative position of the exterior long handle with respective to the lock sub-assembly at the normal, unlocked state of FIG. 3.
Figure 3:
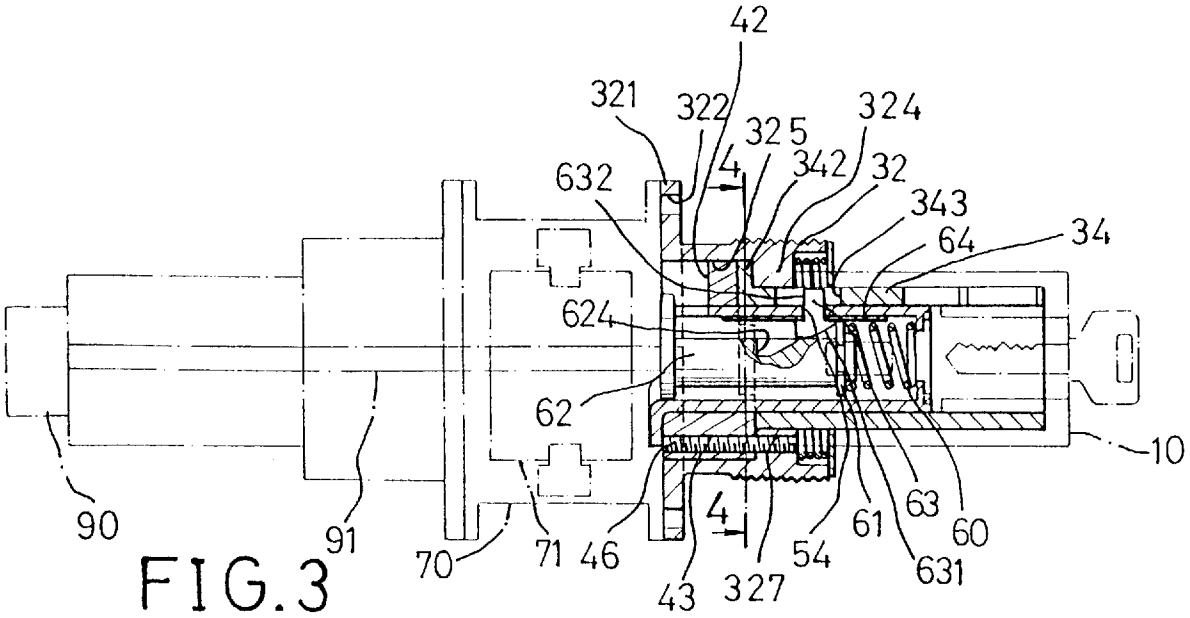
FIG. 3 is a cross-section of the lock sub-assembly of FIG. 2, with other adapted elements shown by dotted lines, in a normal, unlocked state.
Figure 5:
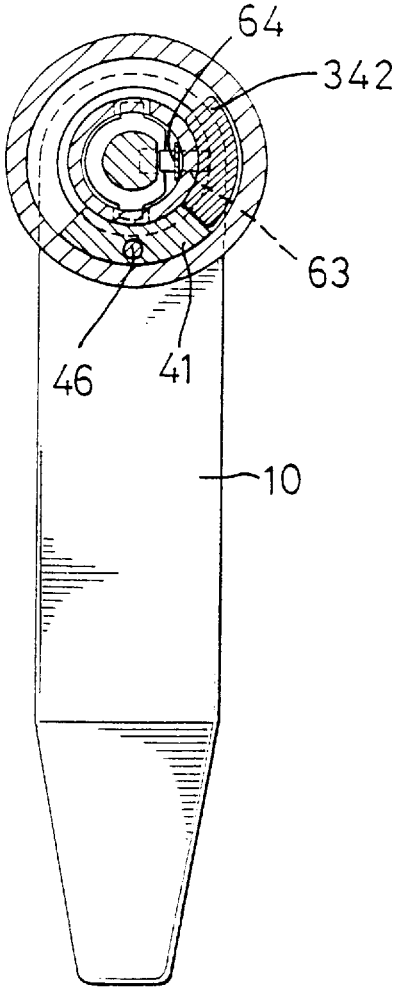
FIG. 5 shows a position of the exterior long handle after turning 90° in a clockwise direction from its position in FIG. 4.

FIG. 3 is a cross-section of the lock sub-assembly in a normal, unlocked state, with other adapted elements shown by dotted lines and FIG. 4 gives a relative position of the exterior long handle 10 with respective to the lock sub-assembly at this normal, unlocked state. In this state, the locking push button 90 is not pressed, the spring stop 61 is at one of its two limit positions as is dominated by a biasing force from the coil spring 60, and the follower 63 is at an elevated position because a bottom end of the follower 63 contacts the upper planar face of the slider 62 so that the rectangular end 632 protrudes beyond the opening 54 of the spindle 50 and enters into the slot 343 of the handle spindle 34 against a spring force from the plate spring 64. At this state, a handle 10 (FIG. 4) which is coupled to the handle spindle 34 to rotate therewith can transmit a turning movement through the inter-engagement of the follower 63 between the handle spindle 34 and the actuating spindle 50 to the retractor 71 (FIG. 2) by the roll-back portion 56 of the spindle 50. FIG. 5 shows the exterior long handle 10 is turned 90° in a clockwise direction from its position in FIG. 4.

Figure 6:
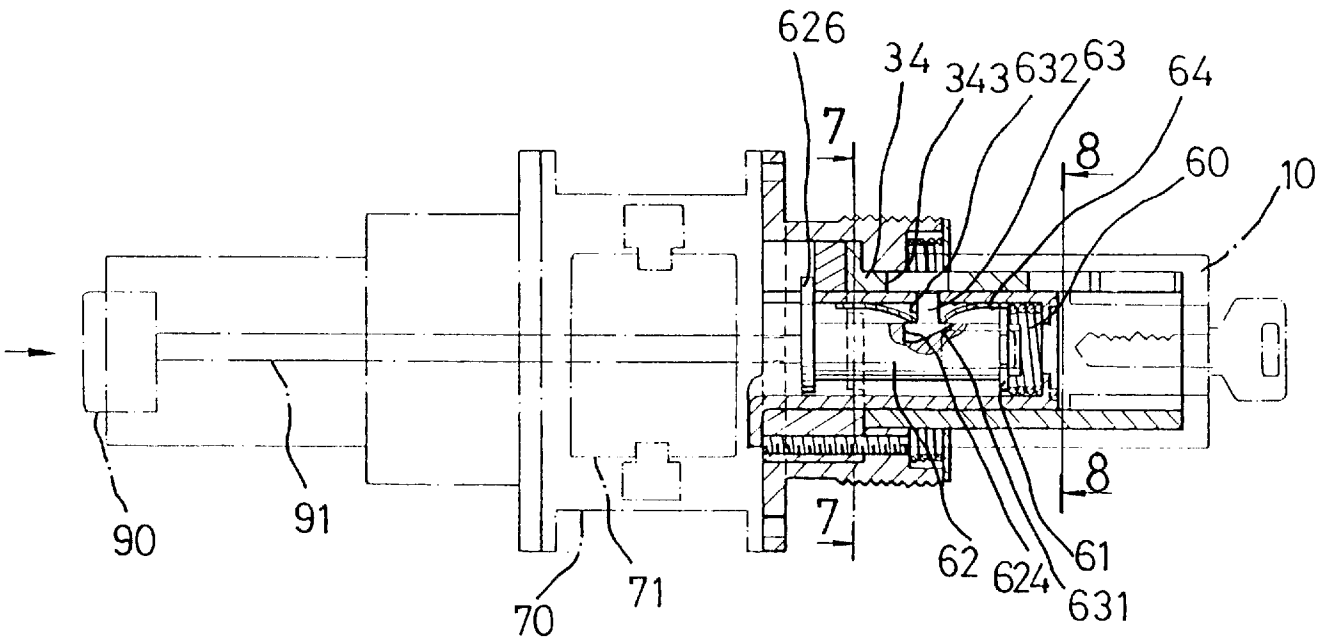
FIG. 6 is a view similar to FIG. 3 but showing a locked state as established by pressing a locking push button.

FIG. 6 shows a locked state of the lock sub-assembly as established by pressing the locking push button 90. During pressing the button 90, the slider 62, together with the spring stop 61 secured to the slider 62, moves in the pressing direction until the wings 611 of the spring stop 61 are stopped by the slots 53 of the spindle 50 with the coil spring 60 being further compressed. At this state, the tapered end 631 of the follower 63 falls into the tapered recess 624 of the slider 62 by the urging force of the plate spring 64 to such an extent that the rectangular end 632 is cleared from the slot 343 of the spindle 34. It is noted that this locked state is sustained by engagement of a bar 91 with the retractor 71 and this engagement then will be released simply by a turning movement of an interior long handle (not shown) which causes the retractor 71, via an interior cam sleeve (not shown), to retract a latch bolt as is well known in this art. With the rectangular end 632 not entering into the slot 343, a mutual turning movement relationship between the two spindles 34 and 50 is released, which means the spindle 34 together with the handle 10 secured thereto are freely turnable. However, it is advantageous to confine this turning movement, such as to protect a key assembly within the handle spindle from damage or a coil spring (not numbered) from becoming over-wound. The provision of the stopper 342 of the spindle 34 in cooperation with the protrusion 41 of the block 40 achieves this purpose.

FIG. 7 shows that the handle 10 is turned from a horizontal position as indicated by dotted lines to a downward position when the lock sub-assembly is at the unlocked state of FIG. 6. Also, in FIG. 7, as can be expected, the follower 63 remains at an upper position since it is not coupled to the slot 343, and thus is not rotated with, the spindle 34.

Referring to FIG. 8, to manipulate the actuating spindle 50 from exterior by way of a key (FIG. 3, not numbered), a tang 80 may be coupled between a key assembly (not shown) and the tabs 52 of the spindle 50. The actuating spindle 50 thus can be easily accessed by a tang or similar elements through a key assembly.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A lock sub-assembly for a cylinder lock having a chassis, a retractor received within the chassis, an interior hub fixed to an interior side of the chassis, an interior long handle and an exterior long handle, the sub-assembly comprising:

an exterior hub configured to be fixed to an exterior side of the chassis, the exterior hub having a protruding step;

a handle spindle rotatable received within the exterior hub and having a stopper, the handle spindle being configured to rotate together with the exterior long handle;

a restricting block fixedly secured within the exterior hub, the restricting block having a protrusion which together with the protruding step of the exterior hub defines a space for a limited turning movement of the handle spindle with respect to the exterior hub;

an actuating spindle extending through both the restricting block and the handle spindle, the actuating spindle having a roll-back portion adapted to operate the retractor; and means for releasably coupling the actuating spindle to the handle spindle;

wherein the exterior hub has a hole through the protruding step thereof and a pair of through-holes in an inner wall thereof;

the restricting block has a bottom threaded hole aligned with the hole of the exterior hub and a pair of side threaded holes aligned with the pair of through-holes of the exterior hub; and a first fastener extending through the hole of the exterior hub and the bottom threaded hole of the restricting block and a second fastener extending through the pair of through-holes of the exterior hub and the pair of side threaded holes of the restricting block, thereby fixedly securing the restricting block within the exterior hub.

2. A lock sub-assembly for a cylinder lock having a chassis, a retractor received within the chassis, an interior hub fixed to an interior side of the chassis, an interior long handle and an exterior long handle, the sub-assembly comprising:

an exterior hub configured to be fixed to an exterior side of the chassis, the exterior hub having a protruding step;

a handle spindle rotatable received within the exterior hub and having a stopper, the handle spindle being configured to rotate together with the exterior long handle;

a restricting block fixedly secured within the exterior hub, the restricting block having a protrusion which together with the protruding step of the exterior hub defines a space for a limited turning movement of the handle spindle with respect to the exterior hub;

an actuating spindle extending through both the restricting block and the handle spindle, the actuating spindle having a roll-back portion adapted to operate the retractor; and means for releasably coupling the actuating spindle to the handle spindle;

wherein the handle spindle has a slot;

the actuating spindle has an opening aligned with the slot, a notch and a pair of slots; and the means for releasably coupling comprises:

a spring stop having a pair of wings slidably received on the pair of slots of the actuating spindle;

a coil spring compressed between the spring stop and an end of the actuating spindle;

a support piece having an ear axially movable within the notch of the actuating spindle;

a slider rotatably received within the support piece, the slider having a disk head for bringing the slider to move together with the spring stop and a tapered recess;

a plate spring having an opening aligned with the opening of the actuating spindle; and a follower having an end extending through the opening of the plate spring and into the opening of the actuating spindle and a tapered end urged by the plate spring to bear against an upper face of the slider and being movable in response to a translational movement of the slider between a first position where the tapered end enters the tapered recess of the slider and the end is cleared from the slot of the handle spindle and a second position where the tapered end leaves the tapered recess of the slider and the end enters the slot of the handle spindle.

3. The lock sub-assembly as claimed in claim 2, wherein a locking push button and a bar is provided to effectuate the translational movement of the slider.

4. The lock sub-assembly as claimed in claim 2, wherein the actuating spindle comprises a pair of tabs adapted to be operable by a tang to turn the actuating spindle when the follower is at the first position.

* * * * *